US006722544B1

(12) United States Patent
Stephens et al.

(10) Patent No.: US 6,722,544 B1
(45) Date of Patent: Apr. 20, 2004

(54) SUBSTANTIALLY NOISELESS FASTENING SYSTEMS FOR APPAREL AND CARRYING PACKS

(75) Inventors: R. Scott Stephens, Lexington, KY (US); Joseph B. Wismann, Lexington, KY (US); Roger L. Weller, Lexington, KY (US); John M. Estes, Winchester, KY (US); Thomas J. Galli, Lexington, KY (US)

(73) Assignee: L-3 Communications Integrated Systems L.P., New York, NY (US)

( * ) Notice: Subject to any disclaimer, the term of this patent is extended or adjusted under 35 U.S.C. 154(b) by 0 days.

(21) Appl. No.: 09/620,410

(22) Filed: Jul. 20, 2000

(51) Int. Cl.[7] ..... A45F 3/04

(52) U.S. Cl. ..... 224/659; 224/235; 2/88; 2/251; 2/252; 2/265; 24/194; 24/196; 24/313; 24/589.1; 24/590.1; 24/595.1; 24/616; 24/669; 24/695; 24/702; 383/64

(58) Field of Search ..... 224/654, 657, 224/658, 659, 235, 236; 2/85, 87, 88, 251, 252, 265, 266; 383/63, 64; 24/194, 196, 313, 615, 616, 589.1, 590.1, 595.1, 702, 595, 695, 669

(56) References Cited

U.S. PATENT DOCUMENTS

| | | | | | |
|---|---|---|---|---|---|
| 729,782 | A | * | 6/1903 | Murphy | 24/669 |
| 882,483 | A | * | 3/1908 | Wilson | 24/669 |
| 1,261,588 | A | * | 4/1918 | Mittelstadt | 24/669 |
| 1,428,358 | A | | 9/1922 | Burbery | |
| 2,105,213 | A | * | 1/1938 | Clark | 24/595.1 |
| 3,122,807 | A | * | 3/1964 | Ausnit | 24/399 |
| 3,261,068 | A | * | 7/1966 | Gurney | 2/128 |
| 3,451,066 | A | * | 6/1969 | Shears et al. | 2/416 |
| 3,454,994 | A | * | 7/1969 | Daddona, Jr. et al. | 24/669 |
| 3,790,992 | A | * | 2/1974 | Herz | 156/251 |
| 4,153,092 | A | | 5/1979 | Haslam | |
| 4,712,280 | A | * | 12/1987 | Fildan | 24/171 |
| 5,442,837 | A | * | 8/1995 | Morgan | 24/400 |
| 5,630,536 | A | | 5/1997 | Bugnaski | |
| 5,729,877 | A | * | 3/1998 | Kong et al. | 24/196 |
| 5,893,504 | A | * | 4/1999 | Baronian et al. | 224/627 |
| 6,060,142 | A | * | 5/2000 | Rossini | 428/52 |
| 6,148,486 | A | * | 11/2000 | Uehara et al. | 24/170 |
| 6,253,428 | B1 | * | 7/2001 | Wang | 24/695 |
| 6,290,114 | B1 | * | 9/2001 | Berberian | 224/637 |

FOREIGN PATENT DOCUMENTS

| | | |
|---|---|---|
| DE | 197 06 764 A1 | 11/1997 |
| DE | 197 29 610 A1 | 4/1999 |
| EP | 0 362 657 | 4/1990 |
| FR | 2 509 616 | 7/1982 |
| WO | WO 99/09854 | 3/1999 |

* cited by examiner

*Primary Examiner*—Stephen K. Cronin
(74) *Attorney, Agent, or Firm*—Baker Botts L.L.P.

(57) ABSTRACT

A substantially noiseless fastening system for a carrying pack includes a flap attached to the shell of the carrying pack along one edge of the flap, a fastener button attached to the flap near a second edge of the flap, and a button receiver attached to the shell. The button receiver has a tapered interference fit slot terminating in a notch for receiving the fastener button, the slot narrowing towards the edge of the flap attached to the shell. The fastening system also includes a pouch attached to the shell, a locking channel attached to the pouch, and a locking groove attached to the shell. The pouch has an edge that forms an opening between the pouch and the shell, and the locking channel engages the locking groove in an interference fit to close the opening. In addition, the fastening system includes a first strap having a first end and a second end, the first end attached to the shell, a second strap having a first end and a second end, the first end attached to the shell, a first fastener attached to the first strap, a second fastener attached to the second strap, and a noise retarding material coating at least part of the surface of the tangs. The first fastener fastens the first strap to the second strap by receiving the second fastener.

17 Claims, 2 Drawing Sheets

SUBSTANTIALLY NOISELESS FASTENING SYSTEMS FOR APPAREL AND CARRYING PACKS

TECHNICAL FIELD OF THE INVENTION

This invention relates to fasteners and, in particular, to substantially noiseless fastening systems for apparel and carrying packs.

BACKGROUND OF THE INVENTION

Military personnel, police personnel, hunters and outdoorsmen use a variety of fasteners—buttons, hook and loop fasteners, metal snaps, zippers, and friction type buckles, for example—to secure apparel and carrying packs while in the field. Unfortunately, during manipulation, many of these fasteners generate distinctive sounds that are detectable at long distances, increasing the likelihood that the personnel will be detected and/or located. Moreover, these fasteners can be non-durable, cumbersome to manipulate, non-weatherproof, and/or degraded by environmental conditions.

SUMMARY OF THE INVENTION

The present invention substantially reduces or eliminates at least some of the problems and disadvantages associated with conventional fasteners for apparel and carrying packs. Accordingly, in particular embodiments, the present invention provides substantially noiseless fastening systems for apparel and carrying packs.

In one embodiment, the present invention provides a substantially noiseless fastening system for a carrying pack. The fastening system includes a flap attached to the shell of the carrying pack along one edge of the flap. The fastening system also includes a fastener button attached to the flap near a second edge thereof. The fastening system further includes a button receiver attached to the shell. The button receiver has a tapered interference fit slot terminating in a notch for receiving the fastener button. The slot narrows towards the edge of the flap attached to the shell. Thus, the button receiver fastens the flap to the shell by receiving the fastener button in the notch.

In another embodiment, the present invention provides a substantially noiseless fastening system. The fastening system includes a fastener button attached to a first part to be fastened to a second part. The fastening system also includes a non-metallic button receiver attached to the second part. The button receiver has a tapered interference fit slot that has a substantially triangular shape configuration terminating in a notch for receiving the fastener button. Thus, the button receiver fastens the first part to the second part by receiving the fastener button in the notch.

In still another embodiment, the present invention provides a substantially noiseless fastening system. This substantially noiseless fastening system includes a first non-metallic fastener component that is attached to a first part and has two receiving ports. The fastening system also includes a second non-metallic fastener component that is attached to a second part and has two flexible tangs for locking engagement with the receiving ports. The fastening system further includes a noise retarding material coating at least a part of each of the flexible tangs to minimize noise during engagement of the second component with the first component.

The present invention has several technical advantages. One advantage of the present invention is providing fastening systems that have substantially noiseless operation. This is an important attribute to military and non-military personnel in the field. In addition, in particular embodiments, the fastening systems are durable, easy to manipulate, weatherproof, and/or environmentally tolerant, all of which are additional important attributes to military and non-military personnel in the field. Further, the fastening systems can be used on both carrying packs and apparel. Thus, personnel using the fastening system derive the full benefit of near silent operation.

Other technical advantages will be readily apparent to one skilled in the art from the following figures, description, and claims.

BRIEF DESCRIPTION OF THE DRAWINGS

For a more complete understanding of the present invention, and for further features and advantages, reference is now made to the following drawings, in which.

DETAILED DESCRIPTION OF THE INVENTION

Figure 1:
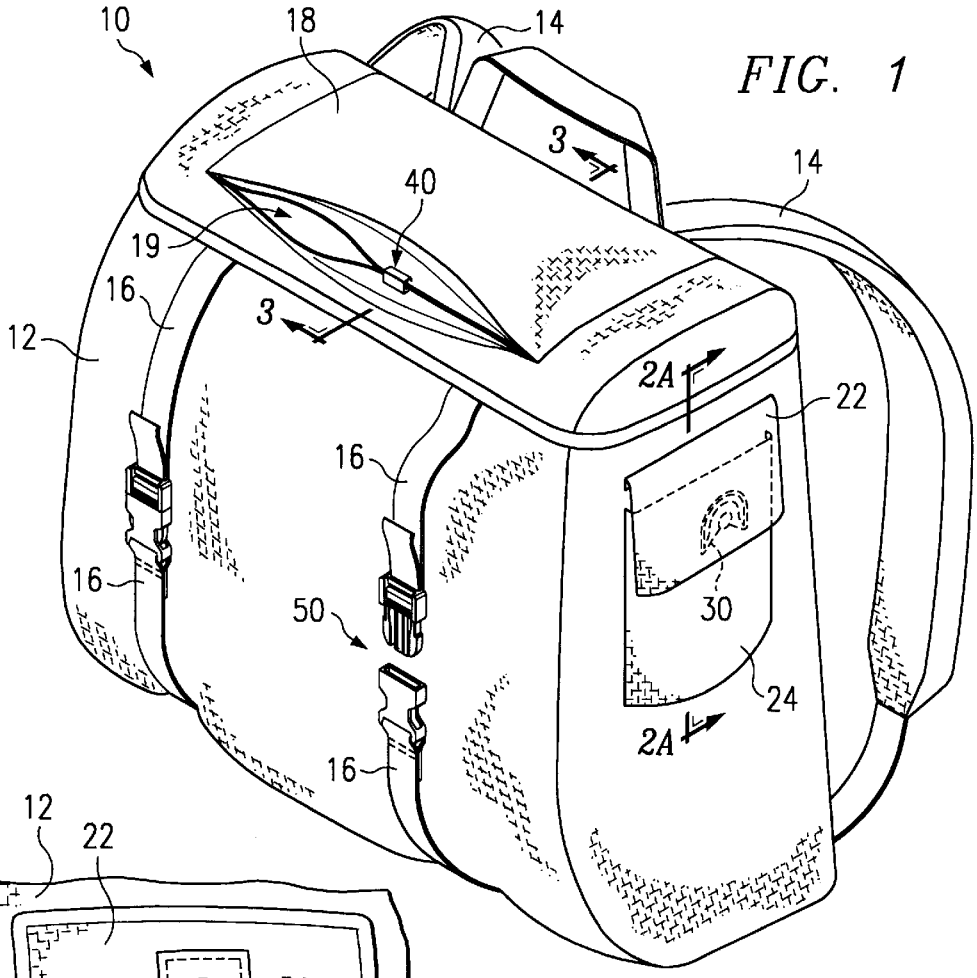
FIG. 1 illustrates a carrying pack utilizing a fastening system in accordance with the present invention.

FIG. 1 illustrates a carrying pack 10 utilizing a fastening system in accordance with the present invention. Carrying pack 10 includes a shell 12 and carrying straps 14, which are coupled to shell 12. A user of carrying pack 10 places items inside shell 12 for carrying as a back pack using carrying straps 14. Carrying pack 10 also includes a variety of devices that need to be fastened together, such as cinching straps 16, the edges of an opening 19 of a pouch 18, and a flap 22 for a pocket 24.

Shell 12, carrying straps 14, cinching straps 16, pouch 18, flap 22, and pocket 24 may be made of nylon, canvas, plastic, and/or any other suitable material. In addition, shell 12, carrying straps 14, cinching straps 16, pouch 18, flap 22, and pocket 24 may be of any size and arrangement on carrying pack 10. In a particular embodiment, carrying pack 10 is a United States Army ALICE pack, on which shell 12, carrying straps 14, cinching straps 16, pouch 18, flap 22, and pocket 24 are commonly found. Accordingly, in ALICE pack, pouch 18 is a map pouch, and cinching straps 16 are used to compress the volume of carrying pack 10.

Several different fastening systems are shown for the illustrated embodiment of carrying pack 10. As can be seen, a first fastening system 30 is shown, albeit in hidden lines, for fastening flap 22 to pocket 24. In addition, a second fastening system 40 is shown for fastening one edge of opening 19 of pouch 18 to another edge of opening 19, thereby closing the opening. Further, a third fastening system 50 is shown for fastening together two ends of cinching straps 16. Each of first fastening system 30, second fastening system 40, and third fastening system 50 will be discussed in greater detail below.

Figure 2B:
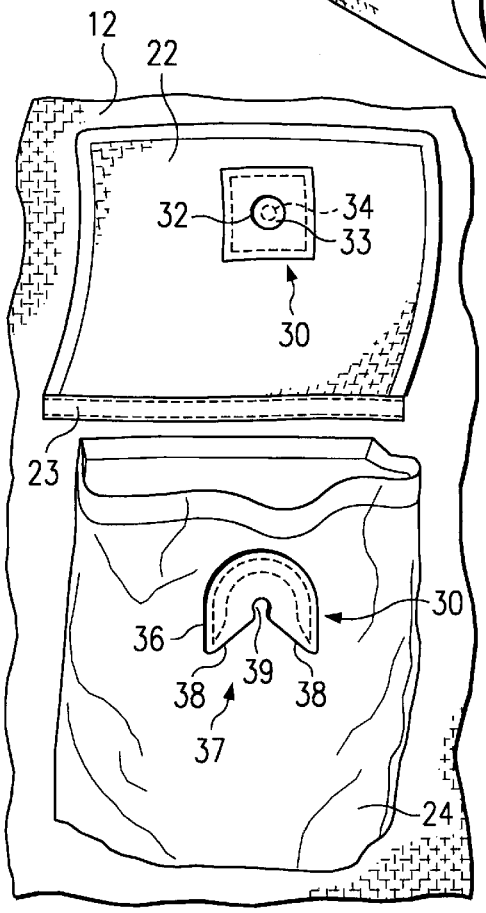
FIG. 2B shows a detailed view of the embodiment of the first fastening system with the first fastening system unfastened.
Figure 2A:
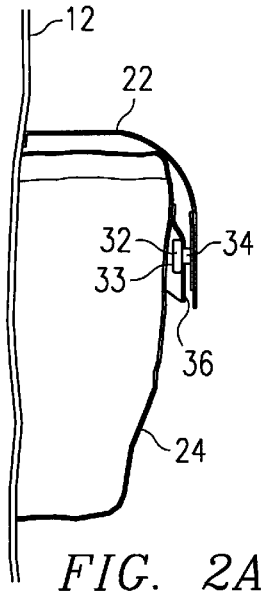
FIG. 2A shows a cross-sectional view of the embodiment of a first fastening system shown in FIG. 1.

FIGS. 2A and 2B illustrated more detailed views of the embodiment of first fastening system 30 shown in FIG. 1. The first fastening system 30 includes a fastener button 32 and a button receiver 36. Fastener button 32 includes a lip 33 and a post 34 attached to flap 22. Post 34 can be attached to flap 22 by sewing, bonding, gluing, and/or any other suitable manner of attachment. Button receiver 36 is attached to pocket 24 and includes a slot 37 having tapered walls 38. Tapered walls 38 terminate into a notch 39. Tapered walls 38 and notch 39 form a tapered interference slot. Button receiver 36 may be attached to pocket 24 by sewing, bonding, gluing, and/or any other suitable manner of attachment.

In operation, flap 22 is folded towards pocket 24 along an edge 23, which is attached to shell 12, until lip 33 of fastener button 32 can be captured underneath button receiver 36. Then, fastener button 32 is moved towards edge 23 until post 34 engages notch 39. The engagement of post 34 with notch 39 provides an interference fit that locks fastener button 32 in place.

Fastener button 32 may be made of plastic, metal, and/or any other suitable material. Button receiver 36 may be made of nylon, canvas, leather, plastic and/or any other suitable material.

First fastening system 30 provides superior performance over standard fasteners for flaps, such as buttons, metallic snaps, friction fit buckles, and hook and loop fasteners. The advantages of first fastening system 30 over these other fasteners are its near noiseless operation, durability, corrosion resistance, and ease of manipulation.

An additional advantage is the ability to use first fastening system 30 on hard canvas components, such as ammunition pouches, or on thick webbed components, such as web belts. For these components, buttons would make good fasteners, but the thickness and non-pliable nature of the material makes it difficult to make and use a button hole. First fastening system 30, however, does not require such because button receiver 36 can be sewn to the material.

A further advantage is no-look operation, which is beneficial for operations in low, or no, light environments, a common occurrence in the field. Buttons, snaps, and friction fit buckles are difficult to use in such environments. However, first fastening system 30 is readily usable because the user can locate slot 37 of button receiver 36 by touch and easily fit fastener button 32 into slot 37 and notch 39.

Although first fastening system 30 has been shown and discussed as being useful for fastening flap 22 to pocket 24, the first fastening system has a variety of other uses. For example, first fastening system 30 could be used to fasten two ends of cinching straps 16 together by placing fastener button 32 on one of cinching straps 16 and button receiver 36 on the mating cinching strap 16. In addition, first fastening system 30 could be used to fasten any type of cover over the opening of a volume. A variety of other uses exist.

Figure 3:
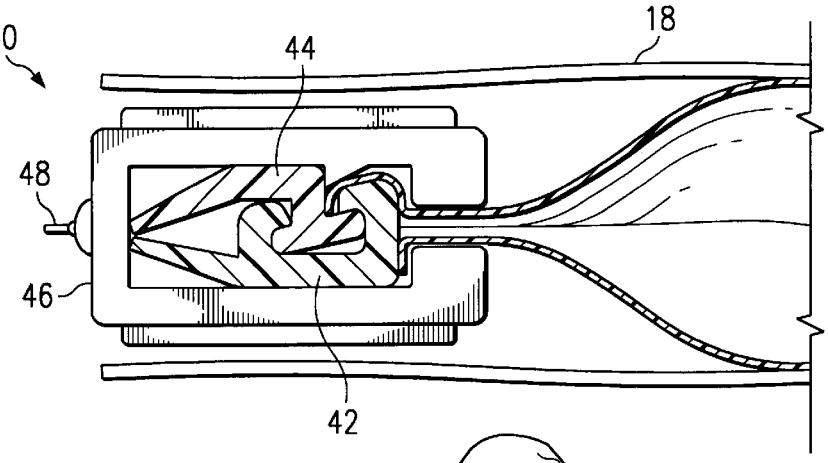
FIG. 3 shows a cross-sectional view of the embodiment of a second fastening system shown in FIG. 1.

FIG. 3 shows a more detailed view of the embodiment of the second fastening system 40 shown in FIG. 1. Second fastening system 40 includes a locking channel 42 coupled to the interior of pouch 18 near one edge of opening 19 and a locking groove 44 coupled to the interior of pouch 18 near another edge of opening 19. Locking channel 42 is sized to engage locking groove 44 in an interference fit. Second fastening system 40 also includes sliding guide 46. Sliding guide 46 engages and disengages locking channel 42 with locking groove 44. In addition, sliding guide 46 includes a pull tab 48 for easier manipulation of sliding guide 46.

In operation, second fastening system 40 closes opening 19 by engaging locking channel 42 with locking groove 44. To engage locking channel 42 with locking groove 44, sliding guide 46 is moved across opening 19. As the sliding guide 46 moves across opening 19, the locking channel 42 engages the locking groove 44.

Locking channel 42 and locking groove 44 may be a pliable plastic, resilient plastic, pliable rubber, and/or any other suitable material. Moreover, locking channel 42 and locking groove 44 can have additional channel and groove pairs for providing a more durable and weatherproof seal. In addition, sliding guide 46 may be a plastic, rubber, metal, and/or any other suitable material.

Second fastening system 40 is a significant improvement over the current fasteners used for closing pouches—such as, hook and loop fasteners and zippers. Some of the advantages offered by the second fastening system 40 include substantially noiseless operation, corrosion resistance, and a weatherproof seal.

Although shown as useful for fastening together two edges of opening 19 of pouch 18, the second fastening system 40 has a variety of other uses. For example, second fastening system 40 could fasten an edge of a pocket to a shell or fasten two parts of a shell together. Thus, second fastening system 40 is useful in many instances where either hook-and-loop fasteners or zippers have traditionally been used, as well as others.

Figure 4:
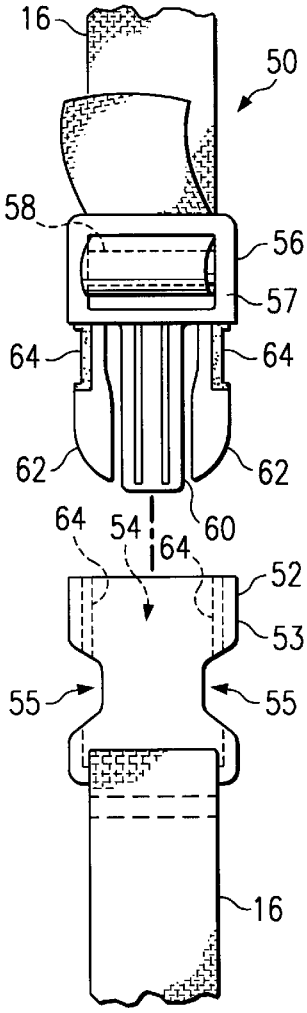
FIG. 4 shows a more detailed view of the embodiment of a third fastening system shown in FIG. 1.

FIG. 4 shows a more detailed view of the embodiment of the third fastening system 50 shown in FIG. 1. Third fastening system 50 includes a first fastener 52 and a second fastener 56. First fastener 52 includes a housing 53 that has an aperture 54 and two receiving ports 55. The interior of the housing 53 is covered with a noise retarding material 64. Second fastener 56 includes a base 57 and flexible tangs 62, mounted to base 57. Base 57 includes a buckle-like bar 58 around which one of cinching straps 16 passes. By passing around buckle-like bar 58, cinching strap 16 is fastened to the fastener 56, thereby securing cinching strap 16 to second fastener 56. Cinching strap 16 may be secured to base 57 in any of a variety of other mechanisms all well known to those skilled in the art. Likewise, flexible tangs 62 may be mounted to base 57 utilizing a variety of techniques. As shown, however, flexible tangs 62 are mounted to base 57 in a cantilevered manner. The flexible tangs 62 include hooks at the end distal from base 57. Second fastener 56 also includes a noise retarding material 64 on part of the outward facing portions of flexible tangs 62 and part of base 57. Third fastening system 50 further includes a guidepost 60 mounted to base 57. In particular embodiments, guidepost 60 is not used.

In operation, to fasten two ends of cinching straps 16 together, second fastener 56 is fastened to first fastener 52. Second fastener 56 is fastened to first fastener 52 by inserting flexible tangs 62 and guidepost 60 of second fastener 56 into aperture 54 of first fastener 52. As flexible tangs 62 are inserted into first fastener 52, the hooks of flexible tangs 62 are deflected towards guidepost 60 by the interior of housing 53 of first fastener 52. Second fastener 56 is then further inserted into first fastener 52 until the hooks of flexible tangs 62 encounter receiving ports 55. Upon encountering receiving ports 55, the hooks of flexible tangs 62 are free to move away from each other. Thus, the hooks of flexible tangs 62 move into receiving ports 55. Due to this movement, second fastener 56 is now fastened to first fastener 52 by the interaction of the hooks of flexible tangs 62 with housing 53 in receiving ports 55. Also due to this movement, noise retarding material 64 encounters the interior of housing 53 of first fastener 52. Because noise retarding material 64 encounters noise retarding material 64 on the interior of housing 53 instead of flexible tangs 62 striking housing 53 directly, third fastening system 50 fastens cinching straps 16 to each other in a substantially noiseless manner. To unfasten second fastener 56 from first fastener 52, the hooks of flexible tangs 62 are again moved towards each other, by applying a force to the hooks in receiving ports 55. Once the hooks of flexible tangs 62 have been moved close enough towards each other to clear the noise retarding material 64 on the interior of housing 53 of first fastener 52, second fastener 56 may be removed from first fastener 52.

First fastener 52 and second fastener 56 may be a plastic, metal, and/or any other suitable material. In addition, noise retarding material 64 may be a pliable plastic, rubber, and/or any other suitable material. Further, noise retarding material 64 may be adhered to, bonded to, or otherwise attached to flexible tangs 62, the interior of housing 53, flexible tangs 62 and guidepost 60, and/or any components of third fastening system 50 that require noise retardation. Moreover, any number and configuration of flexible tangs 62 may be used.

Third fastening system 50 provides numerous advantages over conventional strap fasteners, such as friction type buckles, bayonet fasteners, and metallic snaps. Some of these advantages include substantially noiseless operation, ease of manipulation, durability, and corrosion resistance, when not composed of metal.

Although shown as useful for fastening cinching straps 16 together, the third fastening system 50 also has other uses. For example, the third fastening system may be used to fasten a flap to a pocket or to fasten any two devices having straps attached. A variety of other uses also exist.

Figure 5:
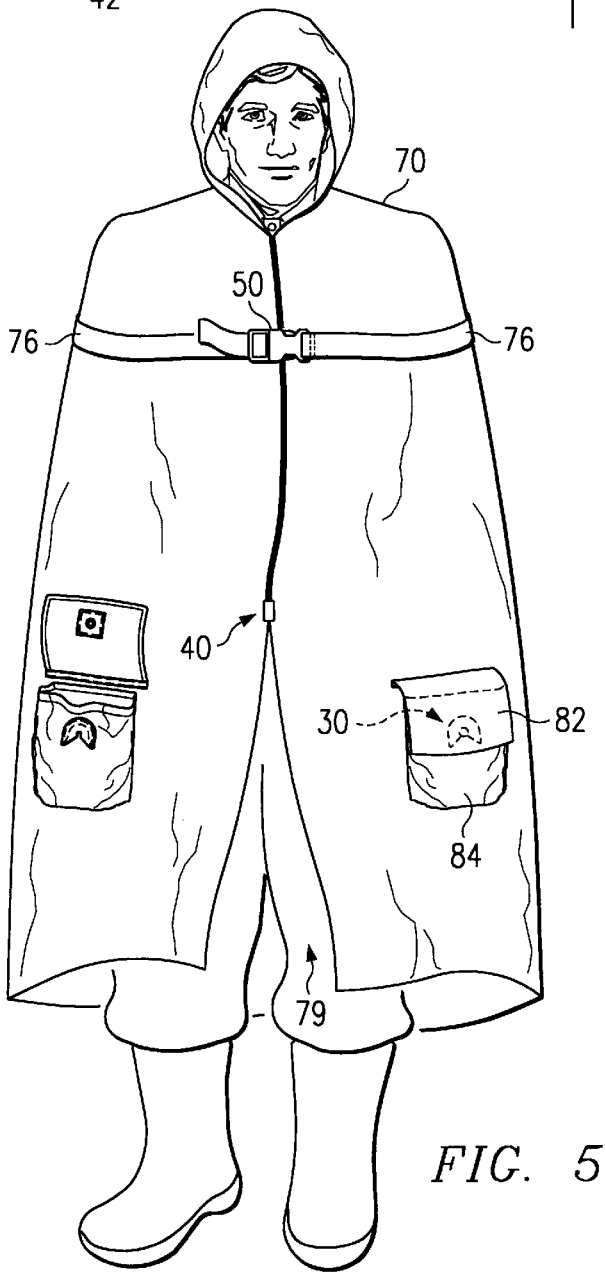
FIG. 5 illustrates a garment utilizing fastening systems in accordance with the present invention.

FIG. 5 illustrates a garment 70 using a fastening system in accordance with the present invention. As with carrying pack 10 in FIG. 1, garment 70 includes a variety of devices that need to be fastened together—such as, cinching straps 76, the edges of opening 79 in garment 70, and flap 82 to a pocket 84. As with carrying pack 10, garment 70 includes first fastening system 30, for fastening flap 82 to pocket 84, second fastening system 40, for fastening the edges of opening 79 together, and third fastening system 50, for fastening cinching straps 76 to each other.

Garment 70 may be a coat, a jacket, a rain poncho, or any other type of apparel. Accordingly, garment 70 may be made of nylon, canvas, plastic, and/or any other suitable material.

Although the fastening system has been described as useful for military apparel and carrying packs, the fastening systems are also useful for a wide variety of other uses. For example, police personnel, hunters, and outdoorsmen would find the fastening systems useful because these people typically require fastening systems that are substantially noiseless, as well as durable, easy to manipulate, weatherproof, and/or environmentally tolerant.

Although several embodiments of the invention have been illustrated and described, numerous other embodiments may be suggested to one skilled in the art through additions, deletions, alterations, and/or substitutions to the described embodiments. It is intended that the scope of the appended claims cover such additions, deletions, alterations, and substitutions.

What is claimed is:

1. A substantially noiseless fastening system, comprising:

a first non-metallic fastener component comprising a housing having two receiving ports;

a second non-metallic fastener component comprising two flexible tangs for locking engagement with the receiving ports; and a noise retarding material coating at least a part of each of said flexible tangs to minimize noise during engagement of the second component with the first component.

2. The fastening system of claim 1, wherein:

the first fastener is coupled to a first cinching strap of a carrying pack;

the second fastener component is coupled to a second cinching strap of a carrying pack; and the first fastener component and the second fastener component operable to fasten the first and second cinching straps together.

3. The fastening system of claim 1, wherein the noise retarding material comprises pliable rubber.

4. The fastening system of claim 1, wherein the noise retarding material comprises pliable plastic.

5. The fastening system of claim 1, wherein the housing comprises an aperture, the aperture operable to receive the two flexible tangs.

6. The fastening system of claim 1, wherein:

the first fastener component is coupled to a first cinching strap of a garment;

the second fastener component is coupled to a second cinching strap of a garment; and the first fastener component and the second fastener component operable to fasten the first and second cinching straps together.

7. The fastening system of claim 1, further comprising a noise retarding material coating at least a part of the housing.

8. The fastening system of claim 7, wherein the noise retarding material coating comprises pliable rubber.

9. The fastening system of claim 7, wherein the noise retarding material coating comprises pliable plastic.

10. The fastening system of claim 9, wherein an interior of the housing is coated with a noise retarding material coating.

11. The fastening system of claim 10, wherein the noise retarding material comprises pliable rubber.

12. The fastening system of claim 10, wherein the noise retarding material comprises pliable plastic.

13. The fastening system of claim 1, wherein the second non-metallic fastener component further comprises a base, the two flexible tangs cantilevered from the base.

14. The fastening system of claim 13, wherein the second non-metallic fastening component further comprises a guidepost, the guidepost mounted to the base.

15. The fastening system of claim 13, wherein the base is coated with a noise retarding material coating.

16. The fastening system of claim 15, wherein the noise retarding material comprises pliable rubber.

17. The fastening system of claim 15, wherein the noise retarding material comprises plastic.

* * * * *

UNITED STATES PATENT AND TRADEMARK OFFICE

CERTIFICATE OF CORRECTION

PATENT NO. : 6,722,544 B1
DATED : April 20, 2004
INVENTOR(S) : R. Scott Stephens et al.

It is certified that error appears in the above-identified patent and that said Letters Patent is hereby corrected as shown below:

Column 3,
Line 1, after “2B”, delete “illustrated” and insert -- illustrate --.

Column 6,
Line 13, after “fastener”, insert -- component --.
Line 42, after “claim”, delete “9” and insert -- 1 --.
Line 53, after “non-metallic”, delete “fastening” and insert -- fastener --.
Line 60, after “comprises”, insert -- pliable --.

Signed and Sealed this

Tenth Day of August, 2004

JON W. DUDAS
*Acting Director of the United States Patent and Trademark Office*